US007886949B2

(12) United States Patent
Fenton et al.

(10) Patent No.: US 7,886,949 B2
(45) Date of Patent: Feb. 15, 2011

(54) CARRYING BAG WITH EXPANDABLE AREA

(75) Inventors: Timm John Fenton, Califon, NJ (US); Paul Victor Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 538 days.

(21) Appl. No.: 11/637,363

(22) Filed: Dec. 12, 2006

(65) Prior Publication Data

US 2007/0181626 A1 Aug. 9, 2007

Related U.S. Application Data

(63) Continuation-in-part of application No. 11/184,321, filed on Jul. 19, 2005, now abandoned.

(51) Int. Cl.
*A45F 3/04* (2006.01)

(52) U.S. Cl. ..... 224/652; 224/645; 224/656

(58) Field of Classification Search ..... 224/627–659; 383/61.4, 72, 74, 75, 76
See application file for complete search history.

(56) References Cited

U.S. PATENT DOCUMENTS

| | | | | |
|---|---|---|---|---|
| 558,728 A | | 4/1896 | Hasselberger | |
| 1,473,849 A | * | 11/1923 | Goldsmith | 2/19 |
| 2,213,821 A | | 9/1940 | McCurdy | |
| 4,949,401 A | * | 8/1990 | Kimsey, Jr. | 2/102 |
| 5,135,222 A | * | 8/1992 | Spector | 473/576 |
| 5,497,919 A | | 3/1996 | Klinger | |
| 5,529,229 A | * | 6/1996 | Fier | 224/153 |
| 5,743,447 A | | 4/1998 | McDermott | |
| 5,957,355 A | | 9/1999 | Swetish | |

(Continued)

FOREIGN PATENT DOCUMENTS

DE 1165816 B 3/1964

(Continued)

OTHER PUBLICATIONS

U.S. Appl. No. 11/184,321, filed Jul. 19, 2005.

(Continued)

*Primary Examiner*—Justin M Larson
(74) *Attorney, Agent, or Firm*—Baker Botts LLP

(57) ABSTRACT

A carrying bag includes a bag body including first and second panels cooperating to substantially form a first compartment therebetween; an expandable compartment configured for housing an object, the expandable compartment including first and second areas cooperating with each other; the first area being connected to the bag body, the first area having two end portions, each end portion comprising a protrusion, and the first area having a fold line approximately along its center, the second area comprising three regions configured to cooperate with each other; and a cord capable of cooperating with the second area for facilitating the cooperation of the three regions. The shape of the protrusions of the end portions prevents the visibility of the first area to a user when the compartment is in an unexpanded configuration. When the compartment is in the unexpanded configuration, approximately half of the first area abuts the second area and approximately half of the material of the first area abuts the first panel.

36 Claims, 10 Drawing Sheets

U.S. PATENT DOCUMENTS

| | | | | |
|---|---|---|---|---|
| 6,053,382 | A | 4/2000 | Wyant | |
| D431,903 | S * | 10/2000 | Worley et al. | D3/232 |
| 6,129,254 | A | 10/2000 | Yu | |
| 6,135,333 | A | 10/2000 | Tucker et al. | |
| 6,298,964 | B1 | 10/2001 | Sadow | |
| 6,305,587 | B1 | 10/2001 | Miller | |
| 6,422,439 | B1 | 7/2002 | Kelliher et al. | |
| 6,516,927 | B2 | 2/2003 | Krulik | |
| 6,533,456 | B1 * | 3/2003 | Buchman | 383/63 |
| 6,691,906 | B2 * | 2/2004 | Cragg | 224/238 |
| 6,698,631 | B1 * | 3/2004 | Haskins | 224/148.4 |
| 6,712,250 | B2 | 3/2004 | Vigny | |
| 6,772,925 | B2 | 8/2004 | O'Hare | |
| 2002/0104859 | A1 | 8/2002 | Kelliher et al. | |
| 2002/0153216 | A1 | 10/2002 | Krulik | |
| 2002/0179653 | A1 * | 12/2002 | Klamm | 224/153 |
| 2006/0102676 | A1 | 5/2006 | Gibson | |

FOREIGN PATENT DOCUMENTS

| | | | |
|---|---|---|---|
| DE | 29908913 | U1 | 9/1999 |
| EP | 1040775 | A | 10/2000 |
| EP | 1277419 | A | 1/2003 |

OTHER PUBLICATIONS

U.S. Appl. No. 11/184/321, Non-final Office Action-Nov. 16, 2009.
U.S. Appl. No. 11/184,321, Final Office Action Response-Sep. 28, 2009.
U.S. Appl. No. 11/184,321, Final Office Action-Jul. 1, 2009.
U.S. Appl. No. 11/184,321, Non-final Office Action Response-Jun. 8, 2009.
U.S. Appl. No. 11/184,321, Non-final Office Action-Mar. 9, 2009.
U.S. Appl. No. 11/184,321, Non-final Office Action Response-Jul. 10, 2008.
U.S. Appl. No. 11/184,321, Non-final Office Action-Apr. 8, 2008.

* cited by examiner

CARRYING BAG WITH EXPANDABLE AREA

PRIORITY AND RELATED APPLICATION

This application claims priority to and is a continuation-in-part of U.S. Ser. No. 11/184,321 filed Jul. 19, 2005 now abandoned entitled "Backpack With Expandable Area" which is incorporated by reference herein in its entirety.

TECHNICAL FIELD OF THE INVENTION

The present invention relates generally to carrying bags and more particularly to carrying bags with expandable compartments.

BACKGROUND INFORMATION

Carrying bags such as backpacks and duffel bags are designed in various sizes and shapes. Some have multiple pockets and are designed to accommodate various articles of various sizes. The helmet design and manufacturing industry strives to provide protective and attractive helmets for cyclists. Since helmets can be awkward to carry when not being worn, some backpacks are designed to accommodate cyclists' helmets.

One concern in designing carrying bags is efficient use of space. Backpacks and duffel bags, for example, should be designed such that they are no larger than required yet can store many objects in that space. Expandable compartments are typically used to serve this purpose. When they are not in use, the expandable compartments are typically zipped shut and do not take up that much extra space.

Conventional expandable compartments suffer from some problems. First, typically the material around the perimeter of the pocket which allows the expansion is such that it does no permit an easy compression of the pocket when the pocket will be zipped close. This sometimes occurs because the material does not fold easily onto itself when the pocket is in the closed position. Second, typical expandable compartments consist of one outer panel attached to a perimeter panel. The one outer panel is typically flat and may not efficiently and aesthetically accommodate items of various sizes and shapes. Moreover, this outer panel typically is attached to the backpack on all of its (the outer panel's) sides, and this contributes to the lack of such various size accommodations.

Since backpacks can be worn be persons of different sizes, adjustability in the straps attaching the backpack to a user is also a desirable feature.

There exists a need to provide a carrying bag which allows transport of objects of varying sizes in an expandable compartment.

SUMMARY OF THE INVENTION

One of the objects of the present invention is to overcome the aforementioned problems and deficiencies.

According to a first aspect of the present invention, a bag includes an expandable compartment. The outer portion of the expandable compartment is divided into three regions. The two outer regions are held to the inner region by use of an expandable cord. They are attached to a perimeter member which is attached to the backpack body. The perimeter member surrounds the compartment approximately three-fourths of the way around. The division of the outer panel into three regions permits expansion and contraction of the pocket without bundling. Thus, this division into three regions permits the expandable compartment to effectively and aesthetically accommodate objects of various sizes and shapes. It is particularly suitable for cyclist helmets.

According to a second aspect of the present invention, the cord is attached to a hook feature on the backpack body. This attachment allows the harnessing of the object in the expandable compartment from becoming dislodged through the top open portion of the compartment.

According to a third aspect of the present invention, the perimeter panel includes a cut out region at each end portion thereof. This cutout allows the perimeter panel to remain out of sight when the expandable compartment is in the contracted position. Without the cutout region, the perimeter panel would be visible over the right and left regions of the outer portion of the expandable compartment. In a preferred embodiment, the cut out regions are in the shape of a "V."

According to a fourth aspect of the present invention, the perimeter panel folds in the shape of a "V" when viewed in cross-section. This permits optimal contraction of the expandable pocket and conserves space.

Figure 1:
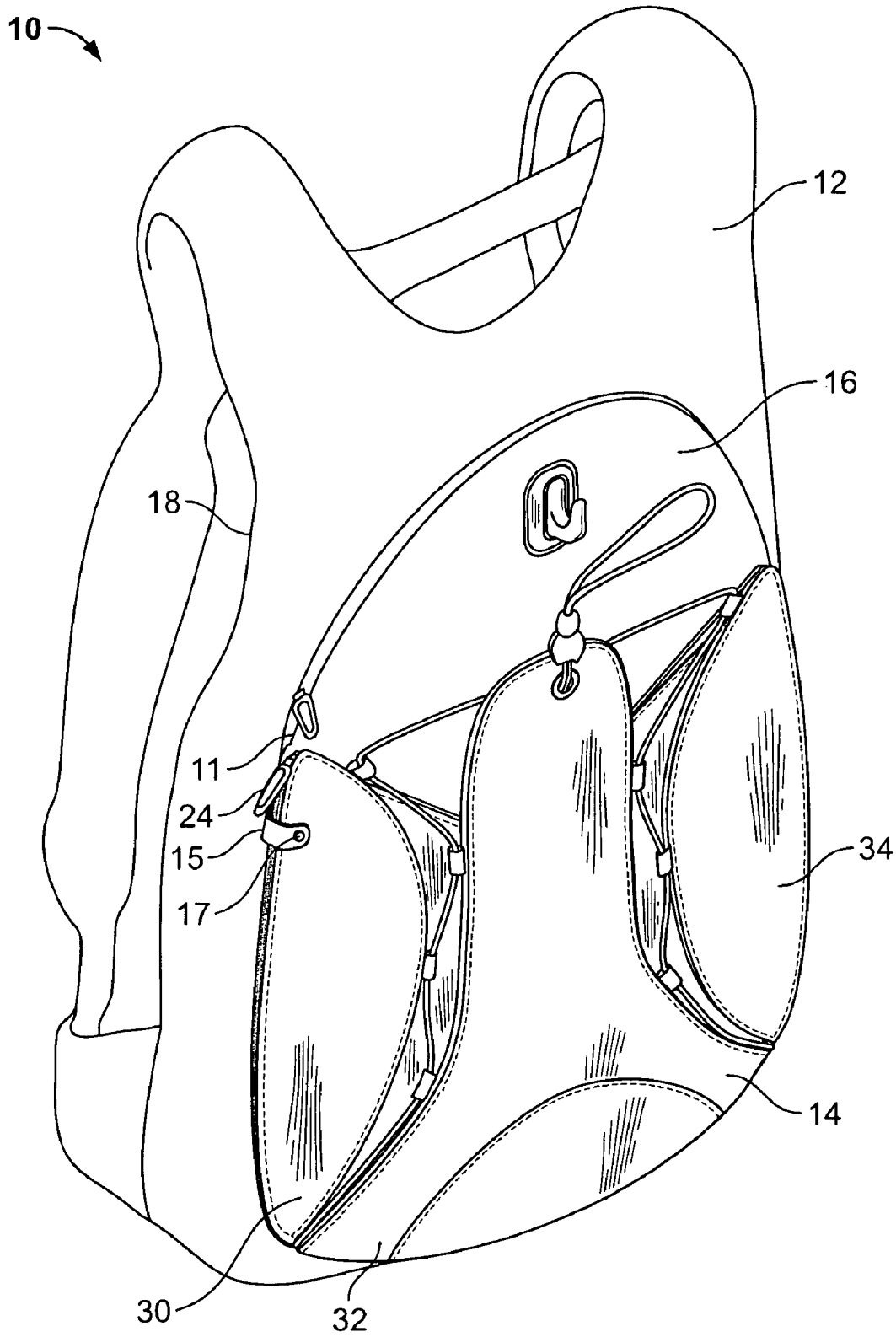
FIG. 1 shows an isometric view of an exemplary embodiment of a backpack according to the present invention.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF EXEMPLARY EMBODIMENTS

FIG. 1 depicts a backpack 10 according to one exemplary embodiment of the present invention. The backpack 10 includes a backpack body 12 and an expandable compartment 14. The backpack body 12 includes a first panel 16 and a second panel 18 used in forming a first compartment 11. The panels 16, 18 may be connected to each other by stitching. The panels 16, 18 may be fabricated from a material such as nylon and polyester and including but not limited to other woven materials. The material may be soft and stretchable or compliant, a hard material, foamed or padded material, or a combination or composite of these various materials. The expandable compartment 14 is shown in the contracted position in FIG. 1.

Figure 5:
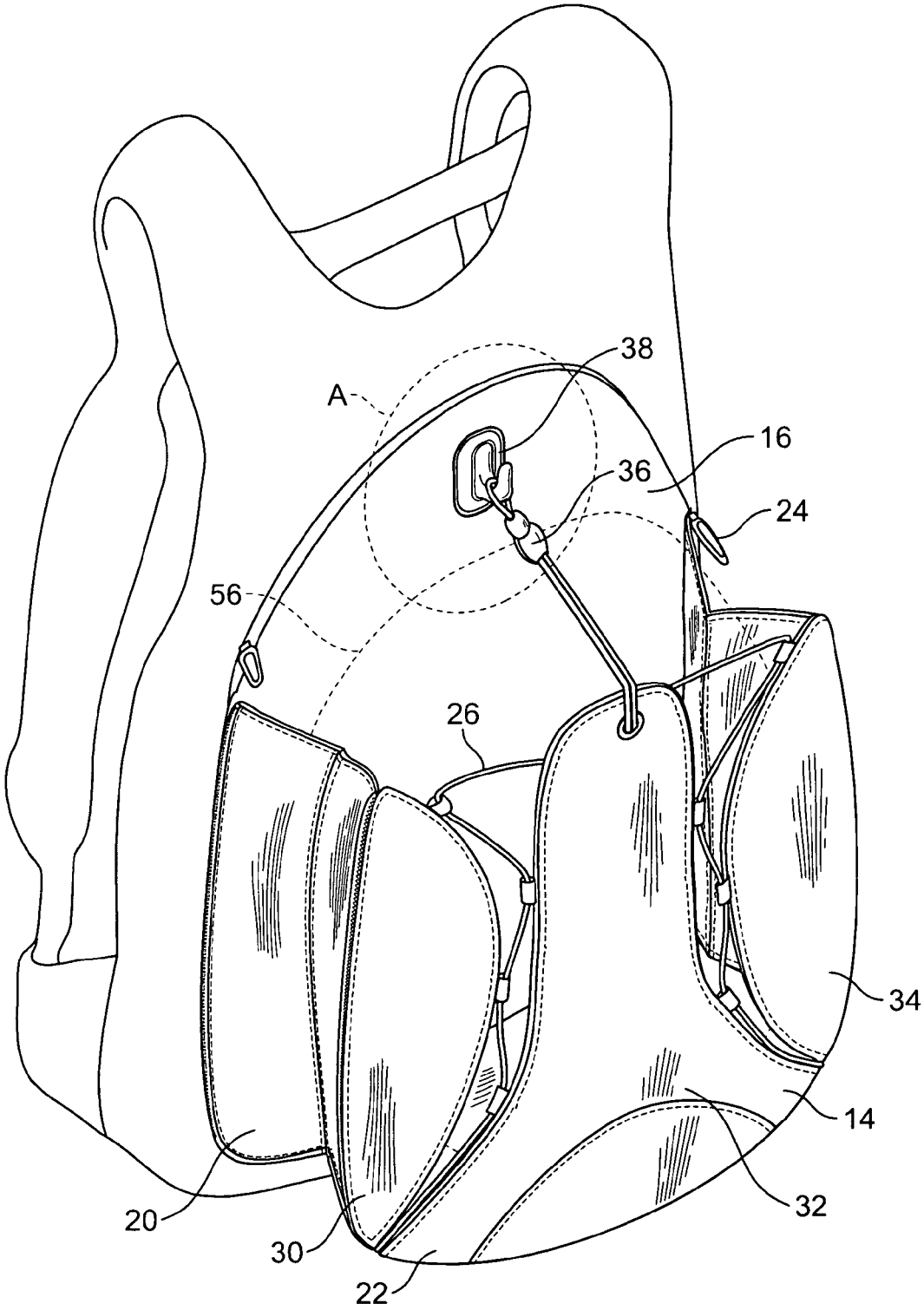
FIG. 5 shows an isometric view of an exemplary embodiment of a backpack with a compartment in an expanded position according to the present invention

FIG. 5 depicts a backpack according to one exemplary embodiment of the present invention. FIG. 5 depicts the backpack with a compartment 14 in an expanded position. The expandable compartment 14 includes a first area 20 and a second area 22. The areas 20, 22 may be fabricated from a similar material as the panels 16, 18. The first area 20 may be connected to the first panel 16 via stitching. The first area 20 may form an approximately semi-circular intersection with the first panel 16, and thus may form a partial perimeter of the expandable compartment 14. The second area 22 may include a first 30, second 32, and third 34 region. These regions are each defined by a boundary edge, where respective boundary edges are spaced apart from one other along substantially an entire vertical length of each region, and where the interior of the expandable compartment is visible through the space between adjacent regions, as shown in FIG. 5.

A zipper 24 may permit expansion of the compartment 14. The zipper 24 may fasten the second area of the compartment 14 to the first panel 16 of the backpack body 12. The zipper 24 may surround the expandable compartment 14 around the entire first area 20. Thus when the zipper 24 is closed, the second area 22 is pulled close to the first panel 16.

Figure 2:
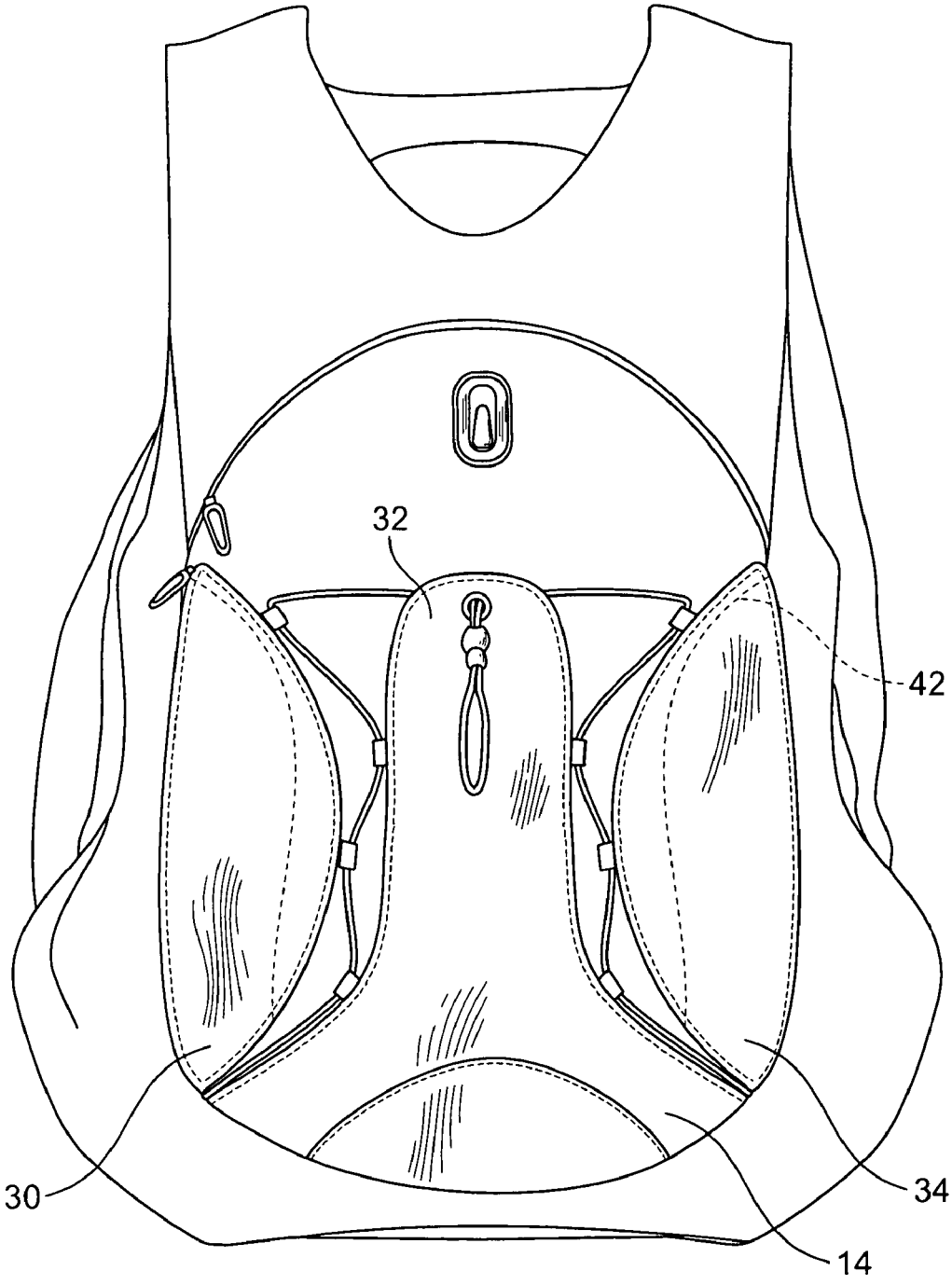
FIG. 2 shows a front view of the backpack of FIG. 1.
Figure 6:
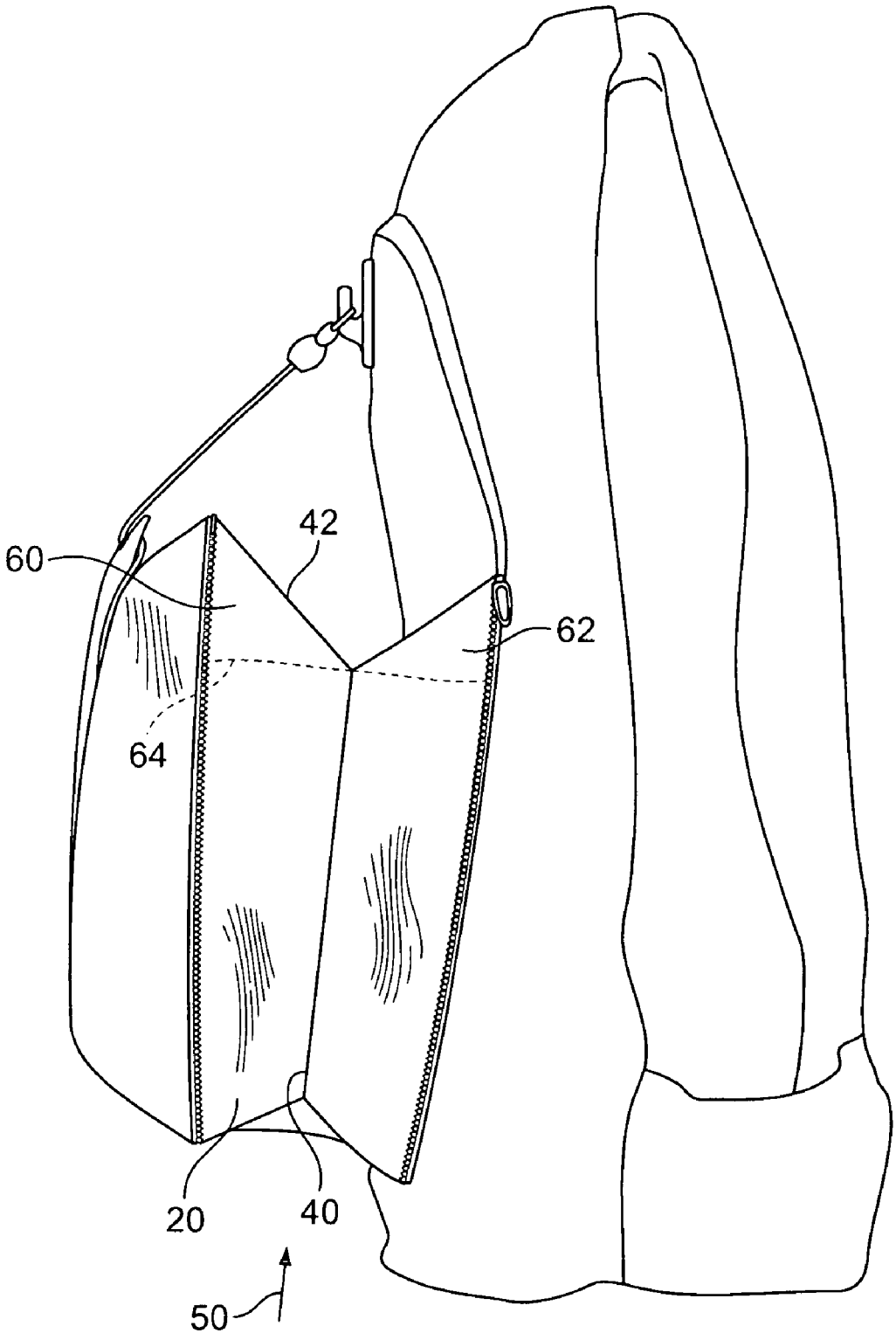
FIG. 6 shows a side view of the backpack of FIG. 5.

As depicted in FIG. 6, the first area 20 may fold approximately along a centerline 40, forming a "V" when viewed in cross-section, in the direction of the arrow 50. This permits optimal contraction of the compartment 14 for example when it is not being used to store a large item. This type of fold may take on all sides of the first area 20. The first area 20 may also include a cut-out region 42 (on both ends), which may also be in the shape of a "V" when viewed in the side view as shown in FIG. 6. This cutout 42 prevents that section of the first area 20 (where the material would be had there been no cutout) from protruding out beyond the first 30 and third 34 regions in the direction of the second region 32 when the compartment 14 is in the contracted position (see FIG. 2). Stated differently, the cut-out region 42 in essence may result in a pair of triangular protrusions 60, 62 being formed on one side of line 64. The protrusions 60, 62 may be a portion of the first area 20. Referring back to FIG. 5, when the zipper 24 is opened, the second area 22 is permitted to expand from the first panel 16, and the first area 20 in conjunction with the second area 22 and the first panel 16 form the expandable compartment 14. The first area 20 may act as the bottom and sides of the compartment 14. The terms "bottom" and "sides" are relative terms here and are descriptive of the backpack when the backpack is in an upright position, as shown in FIG. 5.

The second area 22 may further include a cord 26 attached thereto. The cord 26 may permit the first 30 and second 32 regions to cooperate with each other, and may permit the second 32 and third 34 regions to cooperate with each other. As larger or smaller objects are placed in the compartment 14, a user can adjust the tension on the cord 26. This also adjusts the proximity of the three regions 30, 32, 34 to each other. The cord 26 may also function to assist an object 56 (shown in FIG. 5) placed in the compartment 14 from falling out, by being attached to a hook 38 on the first panel 16 of the backpack body 10. In other words, while the first area 20 may act as the bottom and sides of the compartment 14, the cord 26 may assist to prevent items from becoming dislodged from the compartment toward the top. The term "top" is a relative term and is descriptive of the backpack when the backpack is in an upright position, as shown in FIG. 5. The amount of tension on the cord 26 may be adjustable by an adjusting member 36, which can be positioned in various places on the cord 26. Examples of objects that can be stored in the expandable compartment of the present invention include but are not limited to motorcycle helmets, bicycle helmets, baseball helmets, catcher's masks, basketballs, and soccer balls as well as other relatively large and unwieldy items in need of transport. The expandable compartment 14 may be capable of holding objects larger than the first compartment 11 can hold.

Figure 7:
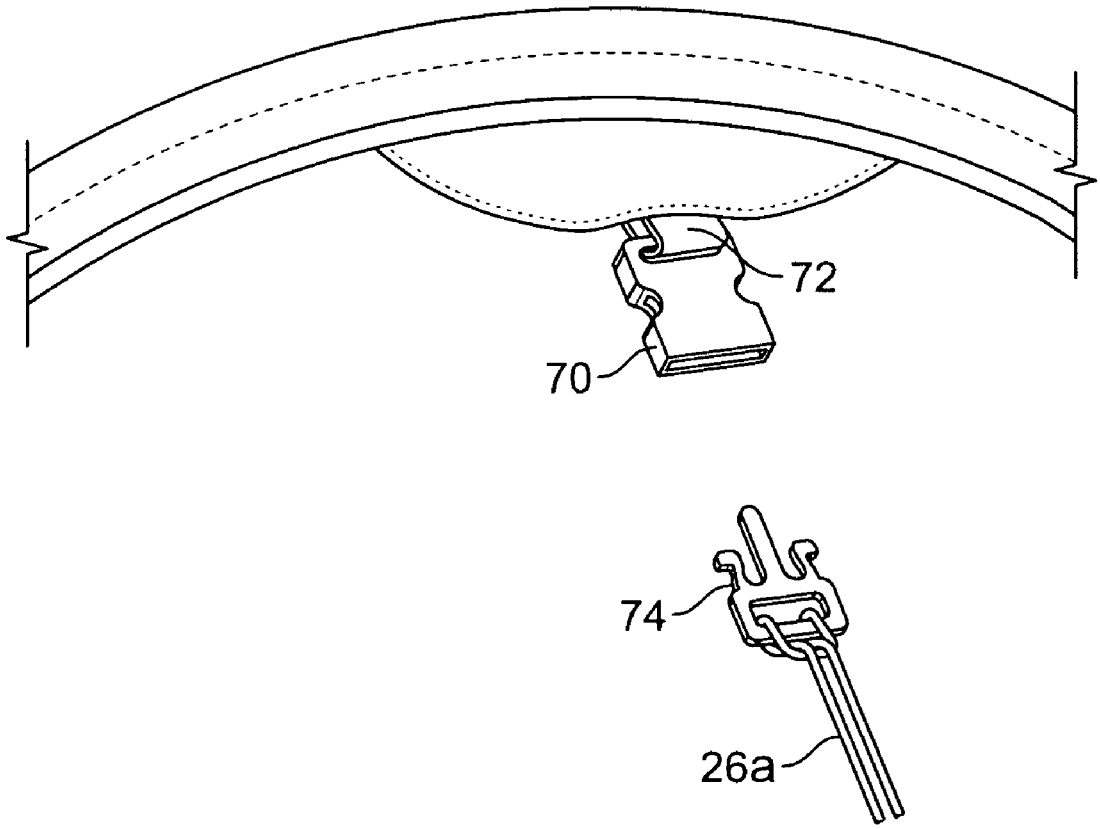
FIG. 7 shows an isometric view of an alternate connecting component used with the backpack of FIG. 5.

FIG. 7 depicts a magnified view of area "A" of FIG. 5, with buckle member 70 instead of the hook 38. The buckle member 70 may be connected to the first panel 16 by a strap 72, which may be may be stitched to the first panel 16 of the backpack body 10. A further buckle 74 may be coupled to the cord 26*a*. The further buckle 74 thus may cooperate with the buckle member 70 to function to assist the object 56 (shown in FIG. 5) placed in the expandable compartment 14 from falling out.

Referring back to FIG. 1, a strap 15 including a snapping member 17 (both shown in FIG. 1) as part of a fastening arrangement may be attached to the backpack body 12 and may be configured to engage a corresponding snapping member (not shown) on the first region 30. The corresponding snapping member preferably should not go all the way through the lining of the first region 30 in order to prevent it from damaging an object placed in the expandable compartment 14. The strap 15 may be attached in the seam where the first and second panels 16, 18 mate. The strap 15 may be used to prevent the zipper 24 from accidentally opening thus keeping the expandable compartment 14 in a closed position. The strap 15 may also serve to keep the end of the zipper 24 from shaking around during transport.

Figure 3:
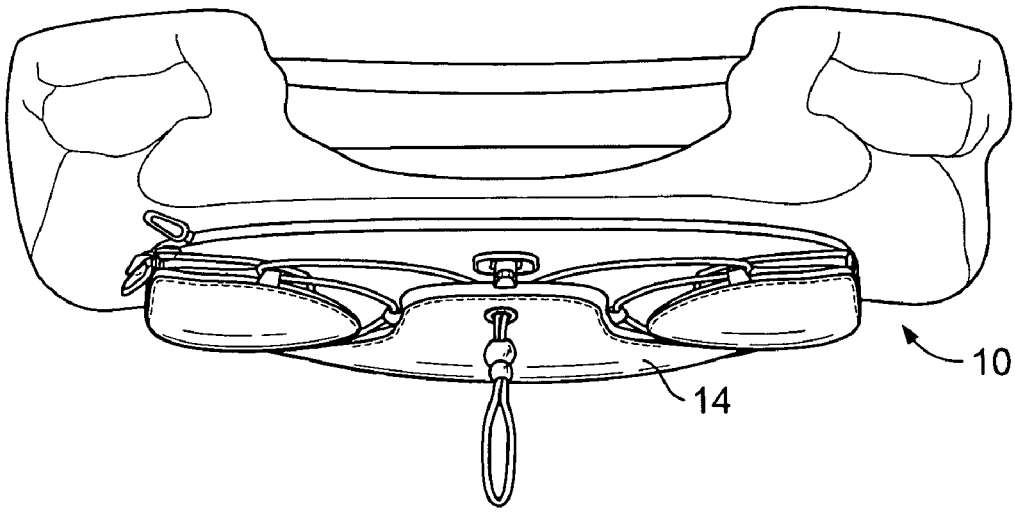
FIG. 3 shows a top view of the backpack of FIG. 1.
Figure 4:
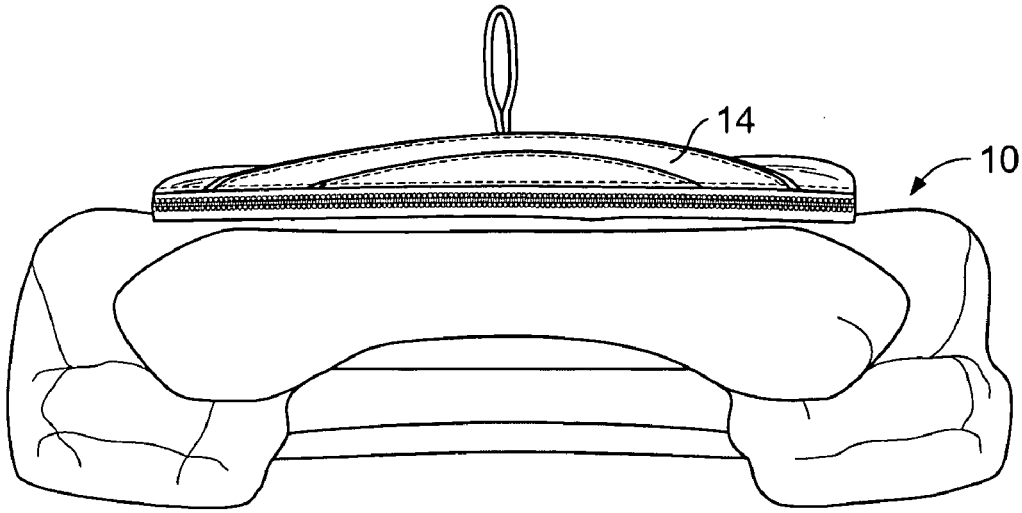
FIG. 4 shows a bottom view of the backpack of FIG. 1.

FIGS. 3 and 4 depict the backpack of FIG. 1 in top and bottom views respectively.

Figure 8:
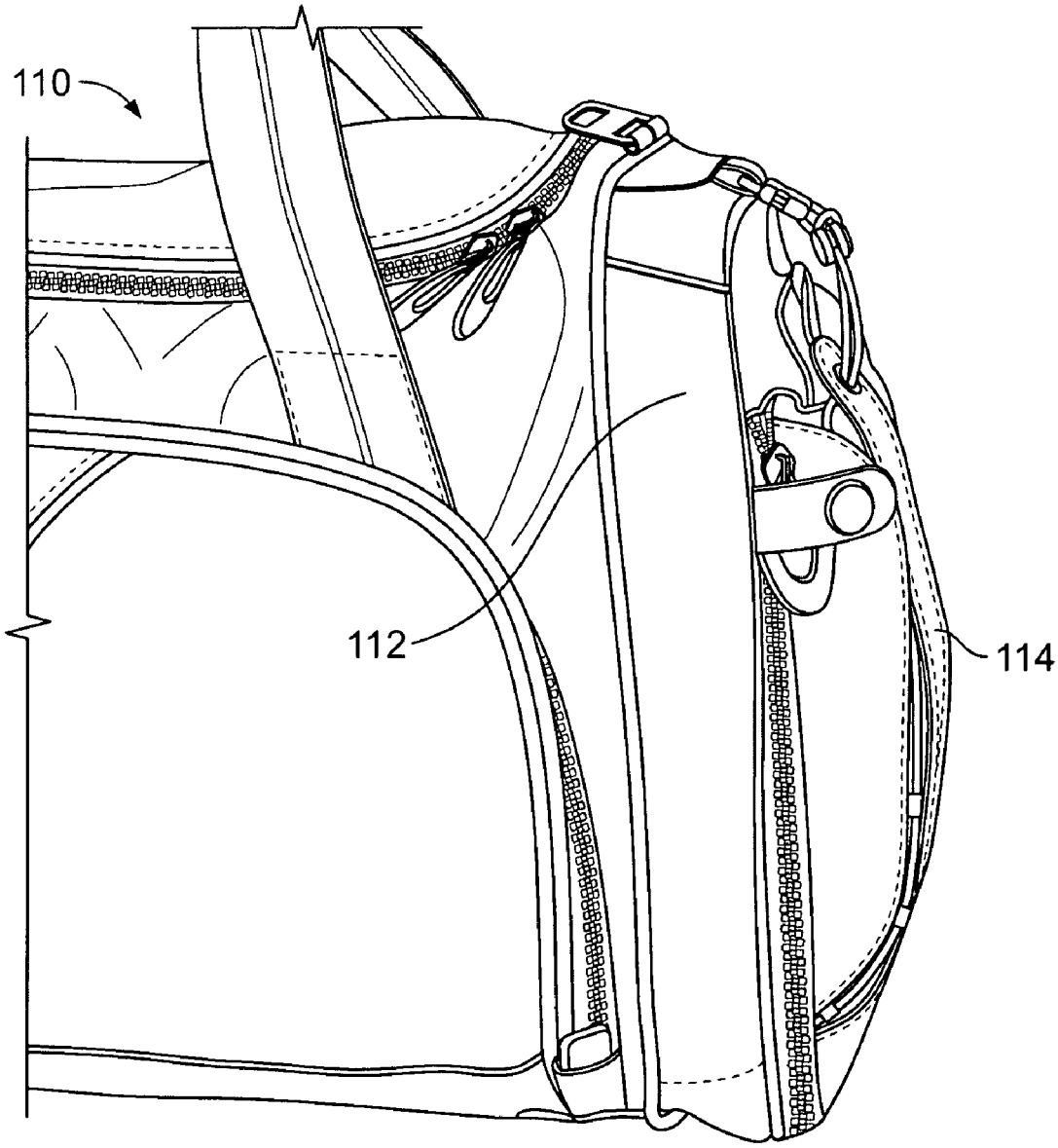
FIG. 8 shows an isometric partial view of an exemplary embodiment of a duffel bag according to the present invention.

The bag in FIG. 8 is in the form of a duffel bag according to an exemplary embodiment of the present invention. The duffel bag 110 includes a body 112 and an expandable compartment 114. The expandable compartment 114 may be substantially similar to the expandable compartment 114 of FIGS. 1-7. Applicant thus makes reference to the text corresponding to those figures for detailed description of the expandable compartment features. Those of skilled in the art will recognize that the invention is not limited to backpacks but may include duffel bags or other types of bags.

Figure 9:
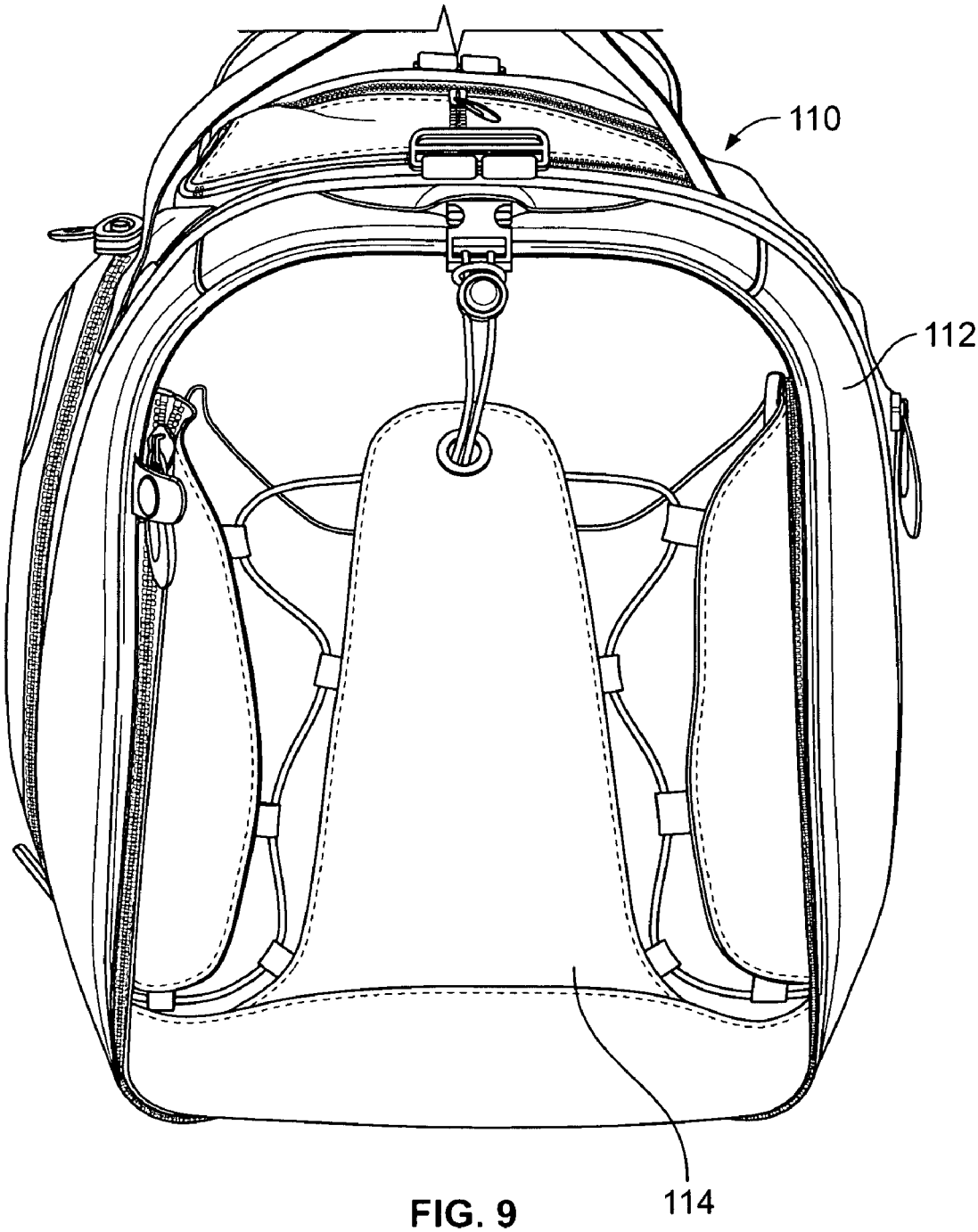
FIG. 9 shows a side view of the duffel bag of FIG. 8.

FIG. 9 depicts a side view of the duffel bag of FIG. 8.

Figure 10:
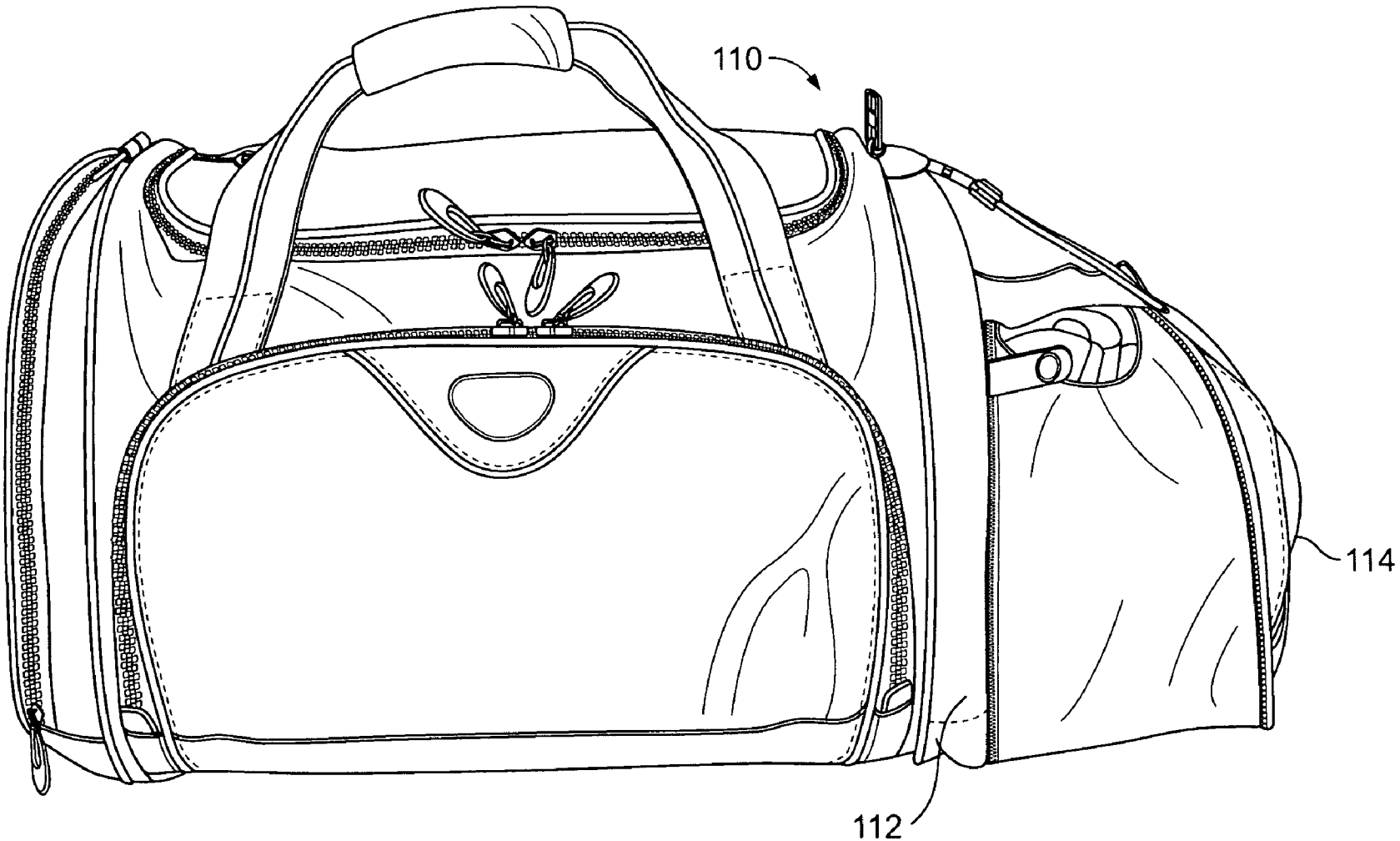
FIG. 10 shows an isometric partial view of an exemplary embodiment of a duffel bag in an expanded position according to the present invention.

FIG. 10 depicts the duffel bag of FIG. 8 in an expanded position with an object 156 placed therein.

Figure 11:
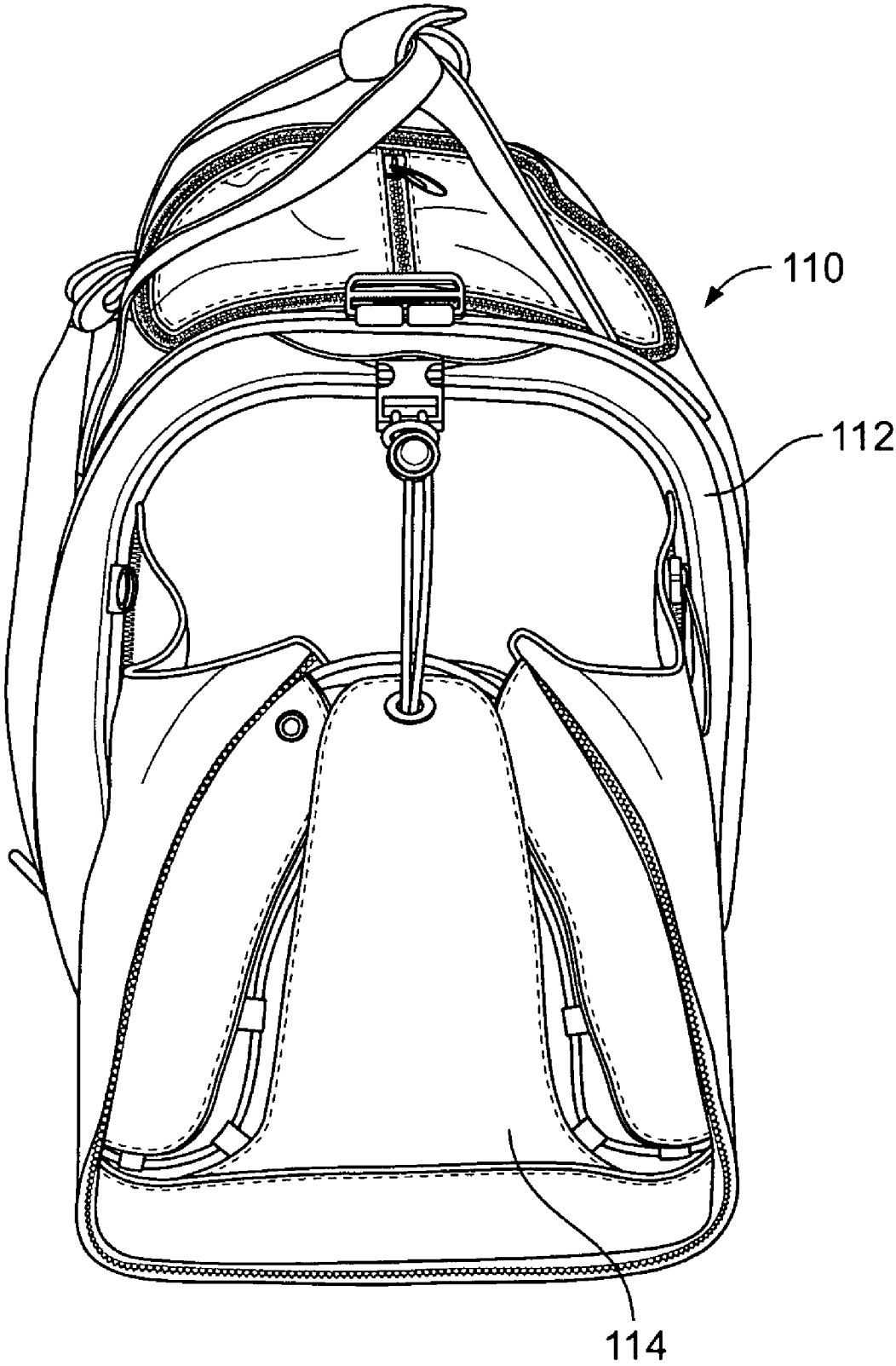
FIG. 11 shows a side view of the duffel bag of FIG. 10.

FIG. 11 depicts a side view of the duffel bag of FIG. 10.

The foregoing merely illustrates the principles of the invention. Various modifications and alterations to the described embodiments will be apparent to those skilled in the art in view of the teachings herein. It will thus be appreciated that those skilled in the art will be able to devise numerous systems and methods which, although not explicitly shown or described herein, embody the principles of the invention and are thus within the spirit and scope of the invention. For example, the second area 22 may include two or four regions instead of three.

What is claimed is:

1. A bag comprising:

a bag body, an expandable compartment configurable for receiving and housing an object through a top of the compartment, the expandable compartment including first and second areas cooperating with each other, the first area being coupled to the bag body, the first area having two end portions, each end portion comprising a pair of protrusions, the second area comprising three regions, each region defined by a boundary edge and capable of cooperating with each other, adjacent boundary edges are spaced from each other along substantially an entire vertical length thereof, the interior of the expandable compartment being visible through the space between adjacent regions and a cord capable of cooperating with the second area on the bag body, the cord disposed between and extending along a length of the boundary edge of at least two adjacent regions with the cord engaging at least one region at a plurality of locations spaced vertically along the length of the boundary edge and facilitating the cooperation of the at least two adjacent regions, wherein the shape of the protrusions of the end portions substantially reduce the visibility of the first area to a user when the compartment is in an unexpanded configuration.

2. The bag of claim 1 wherein each pair of protrusions are configured in the shape of a "V.".

3. The bag of claim 1 further comprising a plurality of harnessing features on each of the three regions, each of the plurality of harnessing features being configured to allow the cord to pass therethrough.

4. The bag of claim 1 wherein the object includes a motorcycle helmet.

5. The bag of claim 1 wherein the object includes a ball.

6. The bag of claim 1, wherein the bag is a duffel bag.

7. The bag of claim 1 wherein the bag body comprises first and second panels cooperating to substantially form a first compartment therebetween.

8. The bag of claim 7 wherein the expandable compartment when in an expanded configuration is larger than the first compartment.

9. The bag of claim 1 further comprising a zipper surrounding a portion of the expandable compartment along the first area wherein operation of the zipper permits expansion of the second area from the first panel of the bag body.

10. The bag of claim 9 further comprising a member for fastening the bag body to a first region.

11. The bag of claim 1 further comprising an engaging member thereon capable of communicating with the cord to prevent the object placed in the expandable compartment from becoming dislodged.

12. The bag of claim 11 wherein the engaging member comprises a hook.

13. The bag of claim 11 wherein the engaging member comprises a buckle.

14. A bag comprising:

a bag body, an expandable compartment configurable for receiving and housing an object through a top of the compartment, the expandable compartment including first and second areas cooperating with each other, the first area being coupled to the bag body, the first area having a fold line approximately along its center, the second area comprising three regions, each region defined by a boundary edge and configured to cooperate with each other, adjacent boundary edges are spaced from each other along substantially an entire vertical length thereof, the interior of the expandable compartment being visible through the space between adjacent regions, and a cord capable of cooperating with the second area and an engaging member coupled to the bag body, the cord disposed between and extending along a length of the boundary edge of at least two adjacent regions with the cord engaging at least one region at a plurality of locations spaced vertically along the length of the boundary edge and facilitating the cooperation of the at least two adjacent regions, wherein each of a plurality of harnessing features is configured to allow the cord to pass therethrough thereby joining said three regions of said second area together, wherein, when the expandable compartment is in an unexpanded configuration, approximately half of the first area abuts the second area and approximately half of the material of the first area abuts a first panel.

15. The bag of claim 14 wherein the object includes a motorcycle helmet.

16. The bag of claim 14 wherein the object includes a ball.

17. The bag of claim 14 wherein the bag is a duffel bag.

18. The bag of claim 14 wherein the bag body comprises first and second panels cooperating to substantially form a first compartment therebetween.

19. The bag of claim 18 wherein the expandable compartment when in an expanded configuration is larger than the first compartment.

20. The bag of claim 14 further comprising a zipper along a substantial portion of the first area wherein operation of the zipper controls expansion of the second area from the first panel of the bag body.

21. The bag of claim 20 further comprising a member for fastening the bag body to a first region.

22. The bag of claim 14 further comprising an engaging member configured to communicate with the cord to prevent the object placed in the expandable compartment from becoming dislodged.

23. The bag of claim 22 wherein the engaging member comprises a hook.

24. The bag of claim 22 wherein the engaging member comprises a buckle.

25. A bag comprising:

a bag body comprising first and second panels cooperating to substantially form a first compartment therebetween, an expandable compartment configured for receiving and housing an object through a top of the expandable compartment, the expandable compartment including first and second areas cooperating with each other, the first area being connected to the bag body, the first area having two end portions, each end portion comprising a pair of protrusions, and the first area having a fold line approximately along its center, the second area comprising three regions, each region defined by a boundary edge and configured to cooperate with each other, adjacent boundary edges are spaced from each other along substantially an entire vertical length thereof, the interior of the expandable compartment being visible through the space between adjacent regions, and a cord capable of cooperating with the second area, the cord disposed between and extending along a length of the boundary edge of at least two adjacent regions with the cord engaging at least one region at a plurality of locations spaced vertically along the length of the boundary edge for facilitating the cooperation of the at least two adjacent regions, wherein, the shape of the protrusions of the end portions prevent the visibility of the first area to a user when the compartment is in an unexpanded configuration, wherein, when the compartment is in the unexpanded configuration, approximately half of the first area abuts the second area and approximately half of the material of the first area abuts the first panel.

26. The bag of claim 25 wherein each pair of protrusions are configured in the shape of a "V.".

27. The bag of claim 25 further comprising a zipper surrounding a portion of the expandable compartment along the first area wherein the zipper permits expansion of the second area from the first panel of the bag body.

28. The bag of claim 25 further comprising a member for fastening the bag body to a first region.

29. The bag of claim 25 further comprising a plurality of harnessing features on each of the three regions, the plurality of harnessing features each having an opening configured to permit the cord to pass therethrough.

30. The bag of claim 25 wherein the object includes a motorcycle helmet.

31. The bag of claim 25 wherein the object includes a ball.

32. The bag of claim 25 wherein the expandable compartment when in an expanded configuration is larger than the first compartment.

33. The hag of claim 25 wherein the bag is a duffel bag.

34. The bag of claim 25 further comprising an engaging member thereon capable of communicating with the cord to prevent an object placed in the expandable compartment from becoming dislodged.

35. The bag of claim 34 wherein the engaging member comprises a hook.

36. The bag of claim 34 wherein the engaging member comprises a buckle.

* * * * *